US005819217A

United States Patent [19]

Raman

[11] Patent Number: 5,819,217

[45] Date of Patent: Oct. 6, 1998

[54] METHOD AND SYSTEM FOR DIFFERENTIATING BETWEEN SPEECH AND NOISE

[75] Inventor: Vijay Rangan Raman, Greenwich, Conn.

[73] Assignee: NYNEX Science & Technology, Inc., White Plains, N.Y.

[21] Appl. No.: 576,093

[22] Filed: Dec. 21, 1995

[51] Int. Cl.[6] ..... G10L 5/00

[52] U.S. Cl. ..... 704/233; 704/215; 704/226

[58] Field of Search ..... 395/2.42, 2.24, 395/2.57, 2.62, 2.35, 2.36, 2.37; 704/200, 214

[56] References Cited

U.S. PATENT DOCUMENTS

| | | | |
|---|---|---|---|
| 4,028,496 | 6/1977 | LaMarche et al. | 395/2.42 |
| 4,204,260 | 5/1980 | Nysen | 364/554 |
| 4,535,473 | 8/1985 | Sakata | 704/248 |
| 4,637,046 | 1/1987 | Sluijter et al. | 395/2.23 |
| 4,688,256 | 8/1987 | Yasunaga | 704/233 |
| 4,945,566 | 7/1990 | Mergel et al. | 395/2.62 |
| 4,979,214 | 12/1990 | Hamilton | 395/2.42 |
| 5,103,481 | 4/1992 | Iseda et al. | 704/249 |
| 5,255,340 | 10/1993 | Arnaud et al. | 704/200 |

*Primary Examiner*—David R. Hudspeth
*Assistant Examiner*—Donald L. Storm
*Attorney, Agent, or Firm*—McDermott, Will & Emery

[57] ABSTRACT

What is disclosed is a signal processing system, wherein a method and apparatus identify background noise in a signal containing speech and noise by separating the signal into frames, evaluating energy levels of selected frames, and identifying the frames as noise if certain consistency tests are met, and speech if certain pulsing, monotone, and speech level tests are met, and transition between speech and noise if transition deviation and consistency levels are met.

27 Claims, 6 Drawing Sheets

METHOD AND SYSTEM FOR DIFFERENTIATING BETWEEN SPEECH AND NOISE

FIELD OF THE INVENTION

The present invention relates in general to communications systems, and more particularly to methods for detecting and differentiating noise and speech in voice communications systems.

BACKGROUND OF THE INVENTION

Speech recognition, detection, verification, and noise reduction systems all require the differentiation of noise versus speech in a communication signal. Regardless of which is being evaluated or manipulated, a system needs to "know" which portions of a signal are speech, and which are noise.

In a typical system, an input signal is sampled and converted to digital values, called "samples". These samples are grouped into "frames" whose duration is typically in the range of 10 to 30 milliseconds each. An energy value is then computed for each such frame of the input signal.

A typical system is often implemented via a software implementation on a general purpose computer. The system can be implemented to operate on incoming frames of data by classifying each input frame as ambient noise if the frame energy is below an arbitrary energy threshold, or as speech if the frame energy is above the threshold. An alternative would be to analyze the individual frequency components of the signal in relation to a template of noise components looking for "matches" to historic noise patterns. Other variations of the above scheme are also known, and may be implemented.

The typical Speech/Noise Detector is initialized by setting the threshold to some pre-set value (usually based on a history of empirically observed energy levels of representative speech and ambient noise). During operation, as certain frames are classified as noise, the threshold can be dynamically adjusted to analyze the incoming frames, thereby creating a better discrimination between speech and noise.

A typical state-of-the-art Noise Estimator is then often utilized to form a quantitative estimate of the signal characteristics of the frame (typically described by its frequency components). This noise estimate is also initialized at the beginning of the input signal and then updated continuously during operation as more noise frames are received. If a frame is classified as noise by the Speech/Noise Detector, that frame is used to update the running estimate of noise. Typically, the more recently received frames of noise are given greater weight in the computation of the noise estimate than older, "stale" noise frames.

Effectiveness of the overall system is critically dependent on the noise estimate; a poor or inappropriate estimate will result in the system working on noise samples when it "thinks" it's working on speech samples, and vice-versa. An example of this would be when speech is actually at a low energy (below the threshold) and is wrongly characterized as noise. Alternatively, noise could be at an energy level exceeding the threshold, and wrongly be classified as speech. Further, in a system which looks for patterns matching historic noise samples, the incoming signal could be noise of a different pattern, and misidentified as speech.

As a consequence of these problems, speech recognition, detection, verification, and noise suppression results would be degraded.

BRIEF DESCRIPTION OF THE INVENTION

The foregoing drawbacks are overcome by the present invention.

What is disclosed is a method and system of noise/speech differentiation which can be used to provide superior identification of noise and speech, resulting in improvements in speech recognition, detection, verification, or noise reduction.

An implementation of the method and system is briefly described as follows:

A standard speech/noise detector can be modified such that the detector performs further analysis on incoming signal frames. This analysis would more accurately identify speech versus noise.

The detector performs a series of tests on incoming signal frames. These new and innovative tests, or any subset or combination of them, will result in superior classification of incoming signals as either noise or speech.

One such innovative test is the Monotone Test. If adjacent frames of a signal exhibit monotonic behavior (uniformly rising or falling energy levels), then the signal is more likely to be speech rather than noise.

Another such test is the Pulsing Test. If a high percentage of samples within a frame have values close to the maximum value in the frame, then the frame is said to be "pulsedff", and is therefore more likely to be speech rather than noise. Of course, similar results could be obtained by evaluating each sample in equivalent alternative ways, such as the square of the value, without deviating from the invention. These alternative evaluations can then be used to identify "pulsing".

Yet another such test is the Transition Deviation Test. This test compares the energy level of the current frame to the previous frame. If the deviation is relatively large, there is a likelihood that the signal is transitioning from speech to noise or vice versa.

A further set of three such tests measure consistency of signal energy. Consistent-1 Test compares the energy of the current frame to the previous frame. Consistent-2 Test compares the energy level of the current frame to each of the past frames in the segment (a group of frames that are classified the same; i.e., speech or noise). Consistent-3 Test compares the energy of the current frame to the average of the energy levels of the frames in the segment or that class of noise.

Generally, consistency is an indicator of noise, and inconsistency is either an indicator of speech, or of a transition between noise and speech.

The final test is the Speech Level Test. This is the only test described in this preferred embodiment which has been previously known and used in the art. When this test is used in conjunction with the above-described new, innovative tests, superior differentiation between speech and noise is obtained.

The Speech Level Test, as used historically and as described previously, is the comparison of the absolute value of the energy level of the current frame with a threshold (either an arbitrary threshold or one derived from previous speech classifications). If the energy of the current frame exceeds the threshold, then the frame is classified as speech. Otherwise, it is classified as noise.

The present invention instead uses the Speech Level Test in conjunction with the other "new tests", in order to better classify a signal as being either speech or noise.

DETAILED DESCRIPTION OF THE INVENTION

Figure 1:
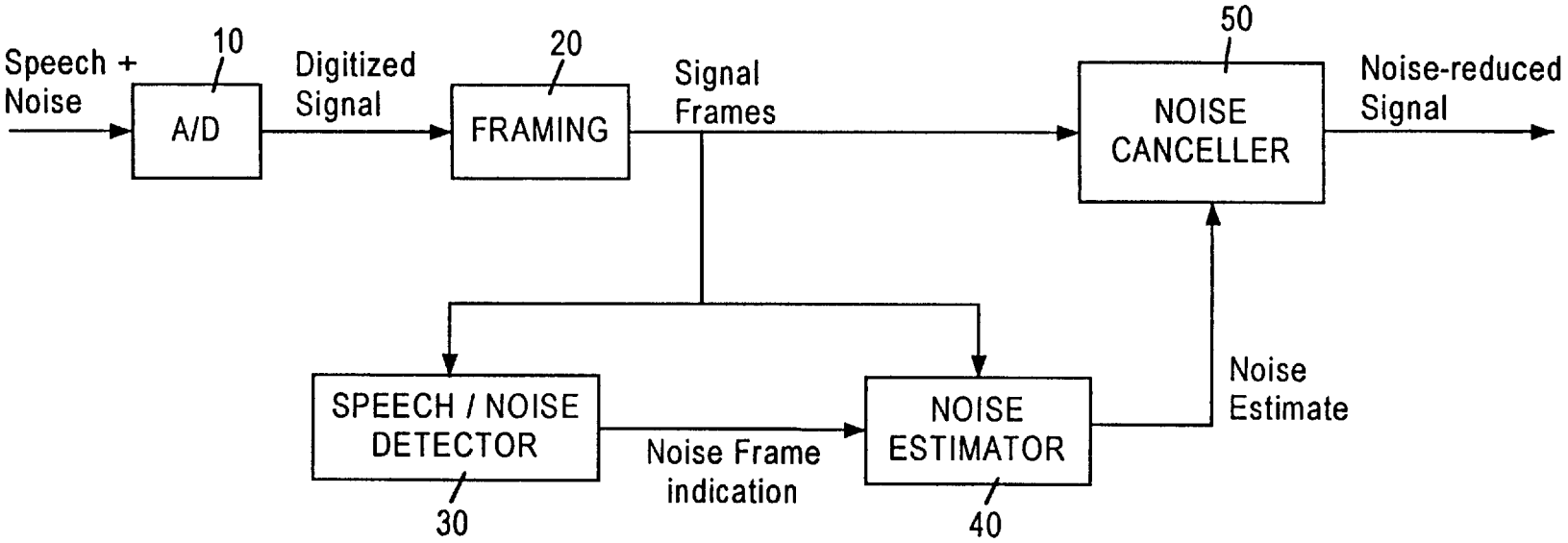
FIG. 1 shows a block diagram of an existing noise canceling system.

FIG. 1 depicts a typical, real-time noise cancellation system. The audio signal enters analog/digital converter (A/D 10) where the analog signal is digitized. The digitized signal output of A/D 10 is then divided into individual frames within framing 20. The resultant signal frames are then simultaneously inputted into noise canceller 50, speech/noise detector 30, and noise estimator 40.

When speech/noise detector 30 determines that a frame is noise, it signals noise estimator 40 that the frame should be input into the noise estimate algorithm. Noise estimator 40 then characterizes the noise in the designated frame, such as by a quantitative estimate of its frequency components. This estimate is then averaged with subsequently received frames of "speechless noise", typically with a gradually lessening weighting for older frames as more recent frames are received (as the earlier frame estimates become "stale"). In this way, noise estimator 40 continuously calculates an estimate of noise characteristics.

Noise estimator 40 continuously inputs its most recent noise estimate into noise canceller 50. Noise canceller 50 then continuously subtracts the estimated noise characteristics from the characteristics of the signal frames received from framing 20, resulting in the output of a noise-reduced signal.

Speech/noise detector 30 is often designed such that its energy threshold amount separating speech from noise is continuously updated as actual signal frames are received, so that the threshold can more accurately predict the boundary between speech and non-speech in the actual signal frames being received from framing 20. This is typically accomplished by updating the threshold from input frames classified as noise only, or by updating the threshold from frames identified as either speech or noise.

The preferred embodiment of the invention is an improvement on speech/noise detector 30 by employing an arrangement and application of the inventive tests described above. It should be noted, however, that one with ordinary skill in the art could make various arrangements of the tests or subsets of the tests, including the use of alternate parameters in the tests, to achieve accurate discrimination between voice and noise in a communications signal. The tests are advantageously performed as follows:

Monotone Test: Within a set of N frames, at least M adjacent frames must display monotonic behavior in energy level; i.e., uniformly falling or rising values (the relative sizes of the steps are not important; rather that they are all rising or all falling). For instance, where N=4, and M=3, there must be at least 3 adjacent frames within the 4 most recently received frames displaying monotonic behavior to be indicative of speech. The reason for this is that noise would not be expected to display monotonicity.

Pulsing: Within a frame of 256 samples, the percentage of samples that are within the proximity of the maximum value are measured. If the percentage exceeds a particular threshold, the frame is classified as "pulsed". For instance, in an advantageous embodiment of this test, the frame average is removed from the absolute value of each sample, and the result is compared to a threshold of 85% of the absolute value of the largest sample in the frame. If the percentage of samples in the frame which exceed this threshold is greater than 1.5%, the frame is classified as "pulsed".

The reason for this test is that speech has a higher probability of being pulsed than stationary noise. Therefore, if noise is at a high energy level, but is not "pulsed", it will be more accurately classified as noise under the "pulse" test, rather than as speech under the normally employed test of energy level.

Transition Deviation Test: This two-frame test compares the energy of the current frame to the previous frame. If the energy deviation is above a pre-selected threshold, the test passes.

For instance, an advantageous threshold would be 10 dB.

The reason for this test is to determine when the signal is in a "transition state"; that is, when speech is decaying into noise, or speech is beginning following noise. During these transition states, the energy deviation from one frame to the next is usually higher than during steady-state noise or steady-state speech. Separate classification of a signal as being in a "transition state" will keep a device from either wrongly classifying the signal at that point as speech (in order to detect, verify, or recognize it), or as noise (in order to reduce or eliminate it).

Consistent-1 Test: This one-frame test compares the energy of the current frame to the previous frame. If the energy deviation is below a threshold, the test passes. Unlike the Transition Deviation test, the threshold is advantageously set at 2 dB for signals above a "low-noise" energy level and 5 dB for signals below that level. In general, the energy level of a frame is calculated as follows:

The individual samples, normally represented by integer values, are normalized (divided by the maximum possible sample value). The average value of the (normalized) samples in the frame is then removed from each of the (normalized) samples, for "de-bias"ing purposes. The sum of the squares of the (normalized and debiased) samples in the frame is now calculated, and divided by the number of samples in the frame. The resulting number represents the frame energy level "e", and a corresponding decibel value relative to an arbitrary reference value "eref" is calculated as 10*log(e/eref). The reference "eref" in this implementation was chosen arbitrarily as 0.03. An example of a "low-noise" energy level could then be set at −30 dB or below, utilizing the above relationship.

Consistent-2 Test: This test compares the energy of the current frame to each of the past frames in the segment. If each and every energy deviation is below a predetermined level, the test passes. Since this test is repeatedly applied as new frames are added to the segment, this guarantees that the deviation between any pair of frames in the segment is below the predetermined level. As in the Consistent-1 Test, the energy deviation threshold is 2 dB for signals above a "low-noise" energy level (threshold), and 5 dB for signals below that level.

Consistent-3: This test compares the energy of the current frame to the average energy level of the frames in the segment or class. If this deviation is below a deviation threshold, the test passes. The deviation threshold is calculated as follows:

The maximum energy deviation of an individual frame in the segment from the segment average is calculated. This is compared to the maximum energy deviation from average in the "noise class" to which this segment belongs, and the larger of the two is chosen. The noise class is determined by a "noise classifier".

Specifically, a maximum deviation value can be computed for the noise class. This is the maximum deviation of energy of any individual noise frame in the class from the class average. This represents the "typical" consistency situation for noise of that class.

The current noise segment has a similar deviation quantity calculated. This represents the deviation seen in this particular instance of the associated class (accounting for some minor changes in the present noise from the entire class).

The maximum of the above two deviations is used for the Consistent-3 Test with a margin added to the greater deviation of the two, to obtain the final threshold. If the present frame meets this test, then the frame is considered part of the current noise segment, and therefore another instance of the determined class (and the current values would be used to update the historic values characterizing the class). Thus, given a noise segment (or class) whose frames lie within a certain deviation-versus-average (Consistent-3 Test), new frames are expected to have deviations within a certain margin of that deviation.

For example, the deviation margin could advantageously be set at 0.3 dB for signal energy above the "low-noise" energy level and 2 dB for signals below that level.

It should be noted that the Consistent-3 Test may result in the allowed deviation gradually growing, allowing greater fluctuation, with the segment still being classified in the same noise class. The test is therefor dynamic, and can "learn" (within limits), accommodating local variations in the noise class without breaking out of the Noise State.

Speech Level Test: The initial speech level is advantageously set at a default SNR value above the estimated noise level obtained from either a previously detected noise segment or the first incoming frame. After a speech segment is identified, the speech level is calculated from the frames in that speech segment. The speech-level threshold is set at a certain margin below the estimated speech level.

For example, the default SNR value is set at 10 dB. The speech threshold margin can be advantageously set at 5 dB, i.e. signals above the speech level minus 5 dB are declared to be in excess of the speech level.

Figure 5:
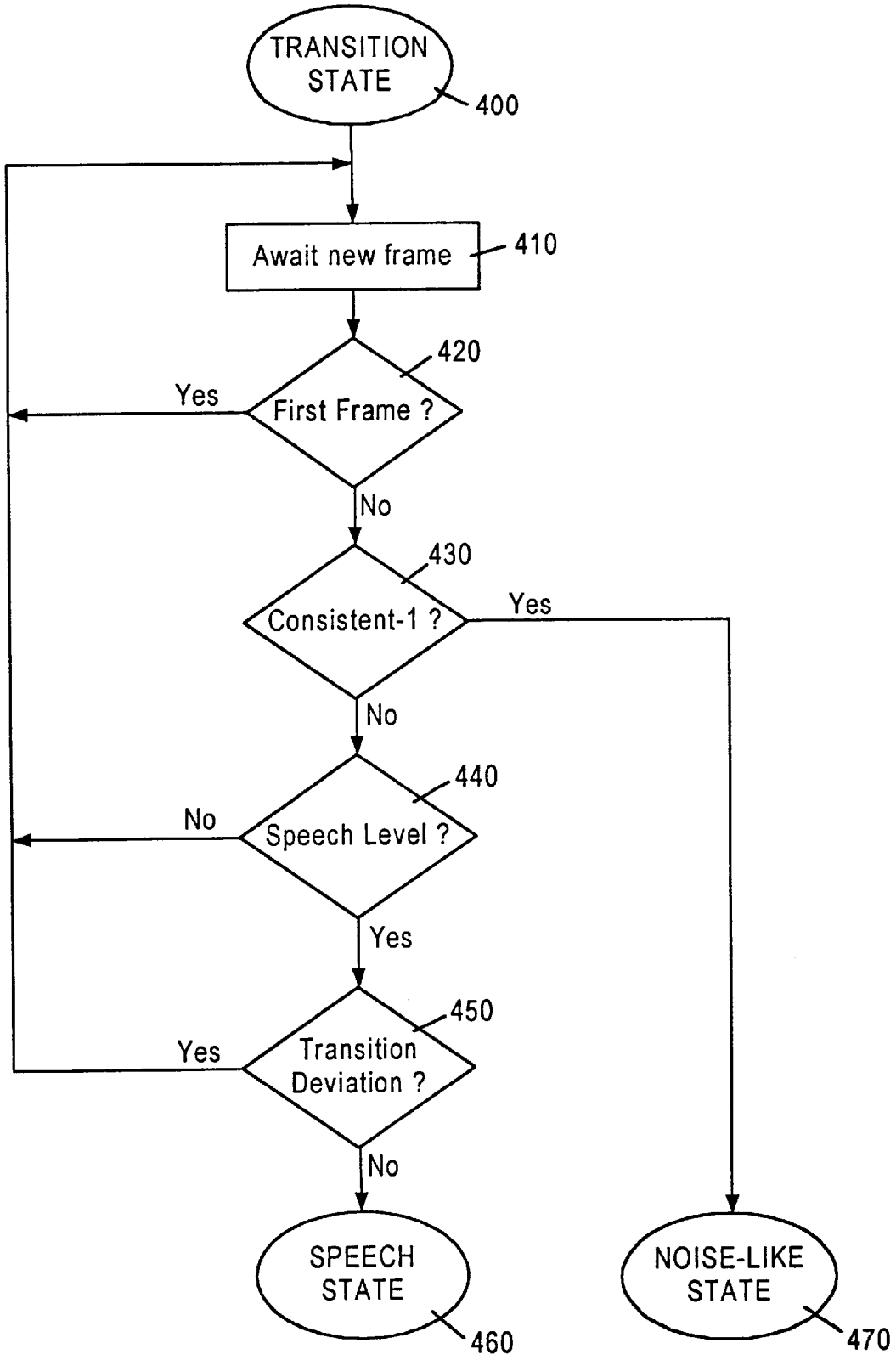
FIG. 5 depicts the workings of the inventive detector while in the Transition State.

The following arrangement of the above-described tests is the preferred method for differentiating between speech and noise of an incoming signal. Referring briefly to FIG. 5, the process identifies and categorizes four "states" (classifications of segments of frames) in order to facilitate the accomplishment of one or more desired tasks (such as speech recognition, detection, verification, or noise reduction). These four states comprise the Speech State (when it is determined that the segment is speech), the Noise State (when it is determined that the segment is noise), the Noise-like State (when it is determined that the segment is probably noise, but more data is required), and Transition State (when the segment is not definitively determined to be either speech or noise). When incoming frames do not appear to be classified the same as the previous frames in a segment, the process categorizes the most recent frames as being in the Transition State, until a more definitive classification into one of the other states can be made.

Figure 2:
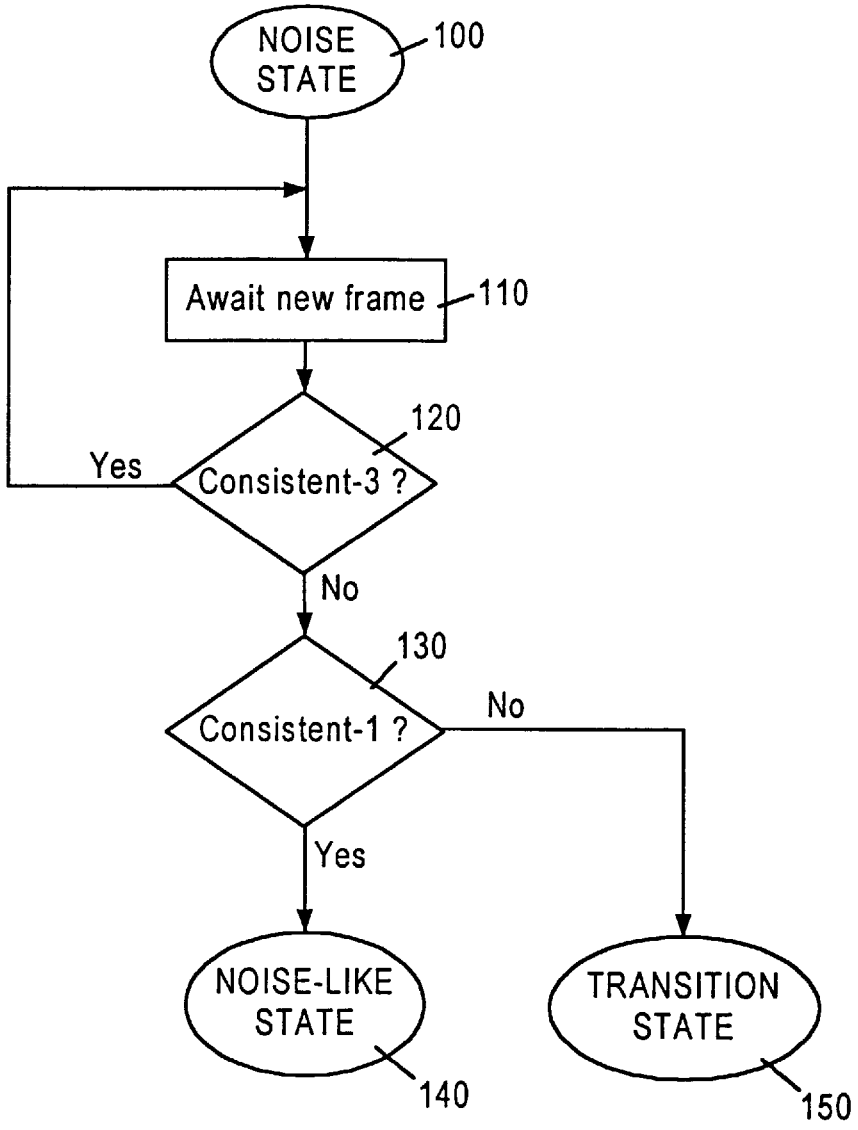
FIG. 2 depicts the workings of the inventive detector while in the Noise State.

FIG. 2 describes the process when in the Noise State. When a new frame is received at 110, Consistent-3 Test 120 is performed. If it passes the test, another frame is received for analysis at 110. If the Consistent-3 Test fails, Consistent-1 Test 130 is performed. If this test passes, the state changes to the Noise-like State at step 140. If the Consistent-1 Test 130 fails, the Transition State is entered at step 150.

Figure 3:
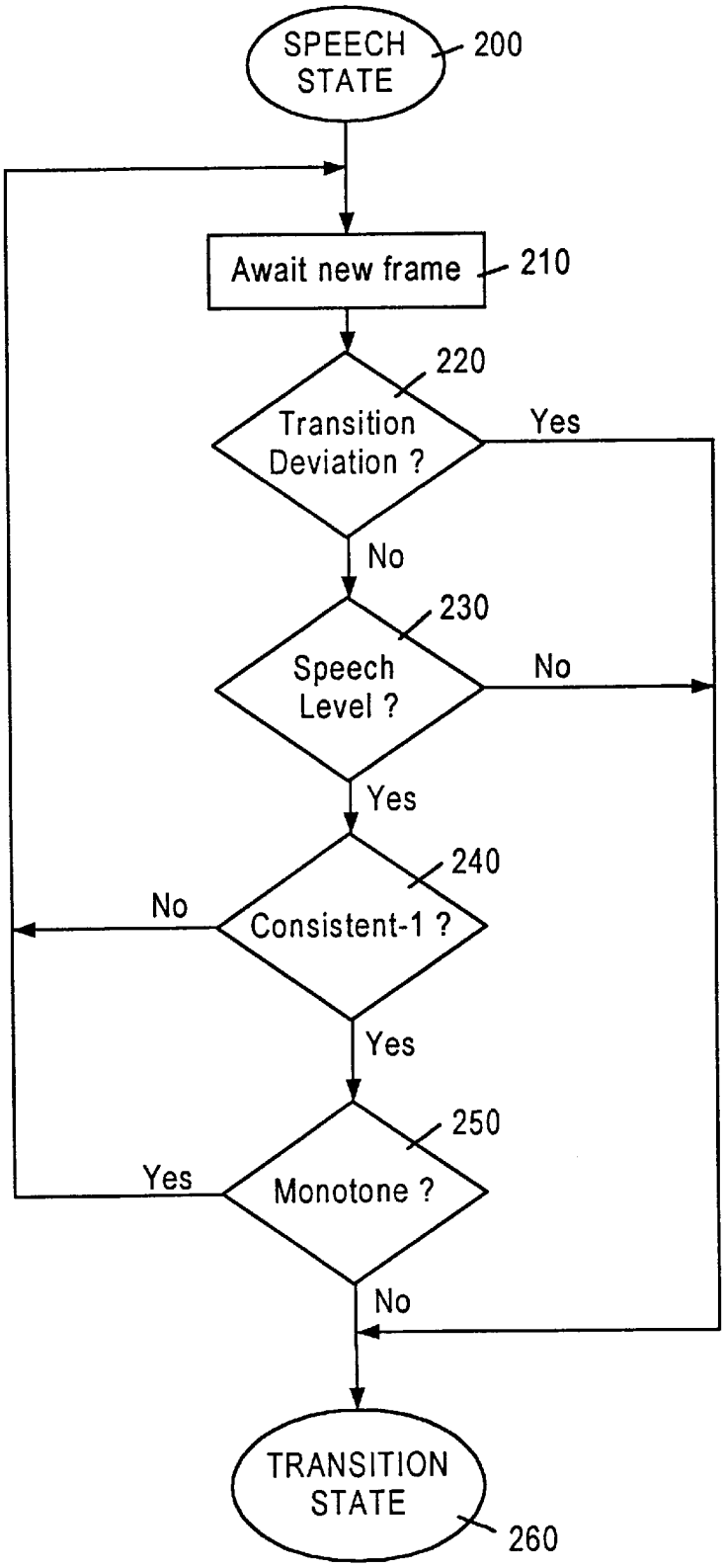
FIG. 3 depicts the workings of the inventive detector while in the Speech State.

Turning to FIG. 3, which describes the process when in the Speech State 200, a new frame is received at 210, followed by the Transition Deviation Test 220. If the test passes, the state changes to the Transition State at 260. If Transition Deviation Test 220 fails, Speech Level Test 230 is performed. If Speech Level Test 230 fails, the state changes to the Transition State at 260. If it passes, Consistent-1 Test 240 is performed. If this test fails, the state remains in the Speech State and a new frame is received at 210. If Consistent-1 Test 240 passes, Monotone Test 250 is performed. If this test passes, the state remains in the Speech State and a new frame is received at 210. If Monotone Test 250 fails, the state changes to the Transition State at 260.

Figure 4:
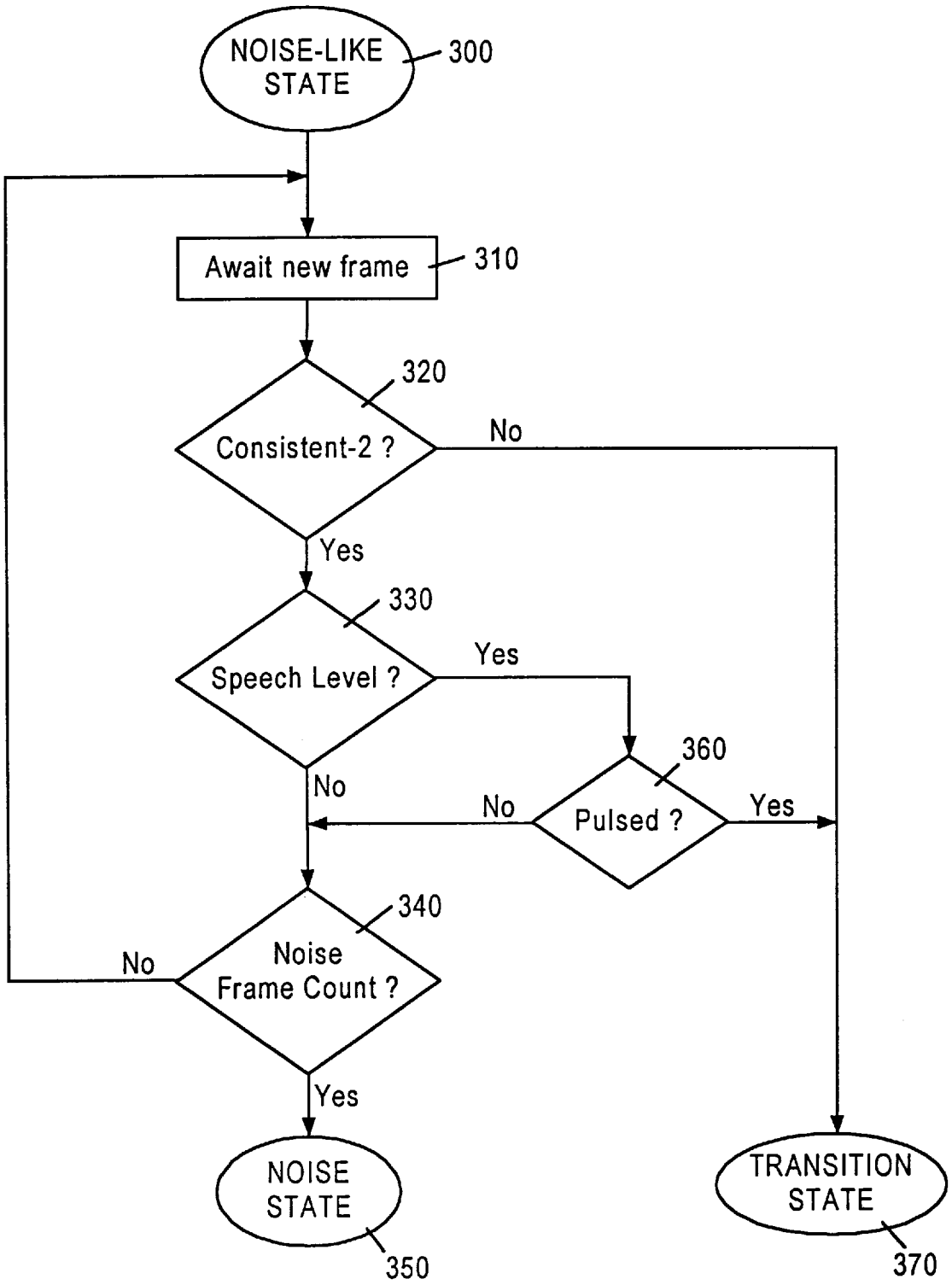
FIG. 4 depicts the workings of the inventive detector while in the Noise-like State.

In FIG. 4, when the current segment is a Noise-like segment at 300, the next incoming frame is analyzed at 310. The Consistent-2 Test 320 is performed, and if it fails, the Transition State is entered at 370. If Consistent-2 Test 320 passes, Speech Level Test 330 is performed. If this test falls, Noise Frame Count 340 is performed. If Speech Level Test 330 passes, Pulse Test 360 is performed. If this test passes, the Transition State is entered at 370. If Pulse Test 360 fails, Noise Frame Count 340 is performed. If an adequate number (advantageously 3) of adjacent noise frames have been detected in Noise Frame Count 340, the Noise State is entered at 350. Otherwise, the state remains in the Noise-Like State and a new frame is received at 310.

In FIG. 5, the current frame (or segment, as the case may be) is determined to be in Transition State 400, and a new frame is received at 410. If this is the first frame (as determined at 420) the next frame is received at 410. If it is not the first frame, Consistent-1 Test 430 is performed. If passed, the Noise-like State at 470 is entered. If not, Speech Level Test 440 is performed. If Speech Level Test 440 fails, another new frame is received at 410. If Speech Level Test 440 passes, Transition Deviation Test 450 is performed. If Transition Deviation Test 450 passes, another new frame is received at 410. If it Transition Deviation Test 450 fails, the Speech State is entered at 460.

Figure 6:
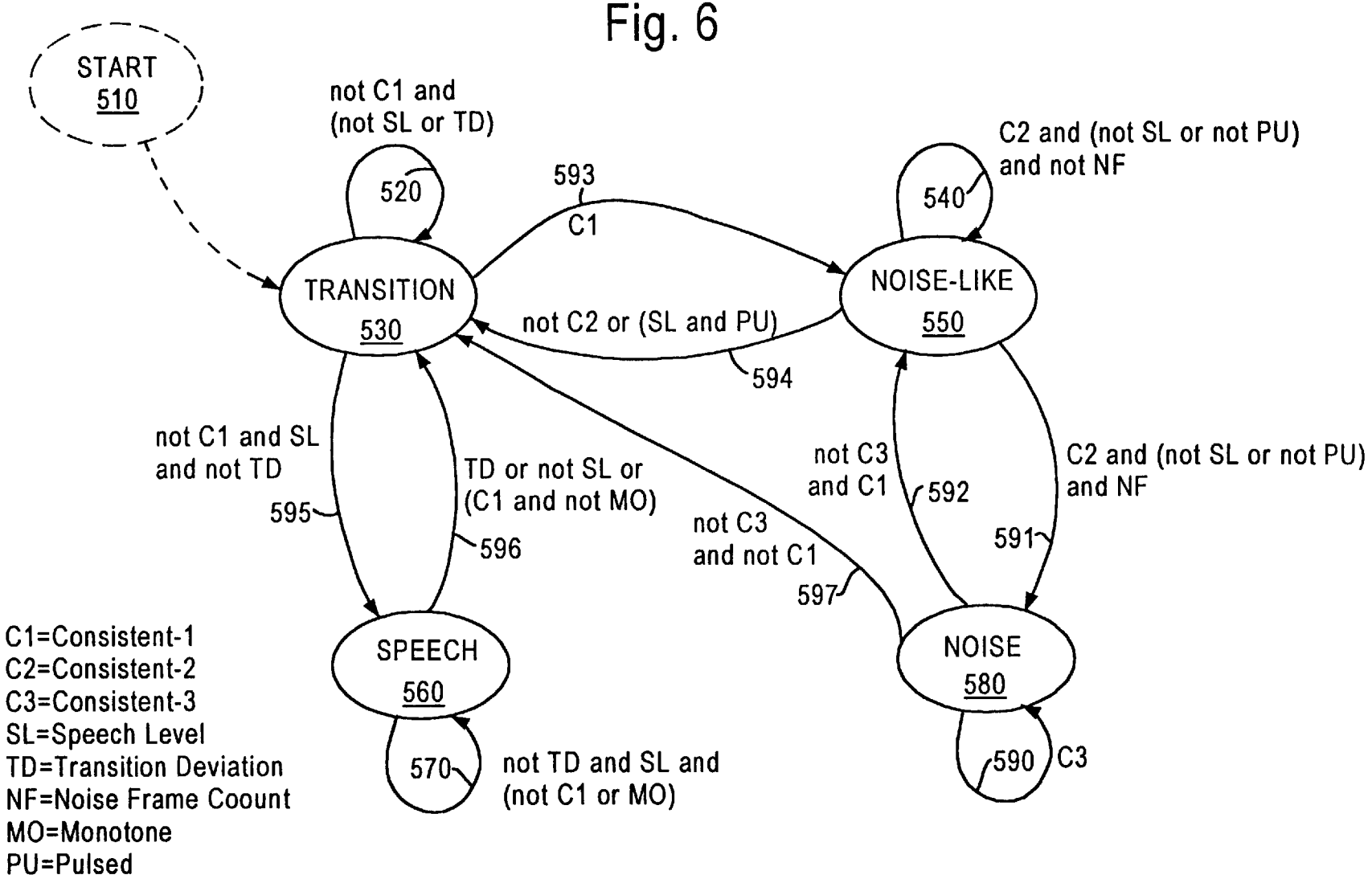
FIG. 6 is a state diagram, depicting the overall decision-making process of the preferred embodiment of the present invention.

FIG. 6 is a state-transition diagram summarizing the four states and the various tests which determine when a different state is entered. A state-transition arc is traversed for each incoming frame of data. The present state would be identified to the downstream process (speech recognition, detection, verification, or noise reduction), in order for the appropriate operations to be performed, based on the classification of the signal at that point.

For instance, if the Speech State is entered, subsequent frames would be flagged as speech (until another state was entered), whereby the speech could be detected, verified, or recognized. If the Noise State was active, subsequent incoming frames would be classified as noise for possible noise reduction, classification, or elimination.

What is claimed is:

1. In a signal processing system, a method for identifying background noise in a signal containing speech and noise, comprising the steps of a) separating the signal into frames, b) evaluating energy levels of at least three adjacent frames, and c) identifying the frames as non-speech if the levels do not exhibit monotonic behavior in energy level.

2. In a signal processing system, a method for identifying background noise in a signal containing speech and noise, comprising the steps of a) separating the signal into frames, b) evaluating energy levels of a subset of at least three adjacent frames within a set of frames, and c) identifying the frames in the set as non-speech if the frames in the subset do not exhibit monotonic behavior in energy level.

3. The method of claim 2 wherein the signal is digitized.

4. In a signal processing system, a method for identifying background noise in a signal containing speech and noise, comprising the steps of a) separating the signal into frames, b) evaluating levels of each sample within a frame, c) calculating a first percentage of samples whose values are within a predefined second percentage of the value of the sample having the largest level, and d) identifying the frame as a transition from noise to speech if the first percentage is below a predefined amount.

5. In a signal processing system, a method for identifying a transition from noise to speech in a signal containing speech and noise, comprising the steps of a) separating the signal into frames, b) evaluating energy levels of three adjacent frames immediately following frames of noise, c) comparing the level of the third of the adjacent frames with each of the levels of the first and second of the adjacent frames, and d) identifying the third frame as indicative of a transition from noise to speech if either comparison yields a difference which exceeds a predetermined amount.

6. The method of claim 5 wherein the identifying step identifies the third frame as indicative of a transition from noise to speech if either comparison yields a difference which exceeds a first predetermined energy level if the energy level of the third frame is above a predetermined energy threshold or exceeds a second predetermined energy level if the energy level of the third frame is below the energy threshold.

7. In a signal processing system, a method for identifying background noise in a signal containing speech and noise, comprising the steps of a) separating the signal into frames, b) evaluating energy levels of a segment comprising at least three adjacent frames, c) calculating a difference value between the last of the adjacent frames and the average energy level of the segment, and d) identifying the last frame as noise if the difference value is less than a predetermined amount.

8. The method of claim 7 wherein a margin is added to the predetermined amount.

9. In a signal processing system wherein a first frame has been characterized as either speech or noise, a method for characterizing the next frame following the first frame as either speech or noise, comprising the steps of a) evaluating energy levels of the first and next frames, b) comparing the difference in levels of the frames to a predetermined value, and c) identifying the next frame as the same characterization as the first frame if the difference is below the value.

10. The method of claim 9 wherein the next frame is characterized as neither noise nor speech if the difference is above the value.

11. The method of claim 9 wherein the value is a first value if the signal is above an energy threshold and a second value if the signal is below the energy threshold.

12. The method of claim 9 wherein the signal is digitized.

13. In a signal processing system wherein a first frame has been characterized as either speech or noise, an apparatus for characterizing the next frame following the first frame as either speech or noise, comprising a) means for evaluating energy levels of the frames, b) means associated with the means for evaluating for comparing the difference in levels of the frames to a predetermined value, and c) means associated with the means for comparing for identifying the next frame as the same characterization as the first frame if the difference is below the value.

14. The apparatus of claim 13 wherein the value is a first value if the signal is above an energy threshold and is a second value if the signal is below the energy threshold.

15. In a signal processing system, apparatus for identifying background noise in a signal containing speech and noise, comprising a) means for separating the signal into frames, b) means associated with the means for separating for evaluating energy levels of three adjacent frames, and c) means associated with the means for separating for identifying the frames as non-speech if the levels do not exhibit monotonic behavior in energy level.

16. In a signal processing system, apparatus for identifying background noise in a signal containing speech and noise, comprising a) means for separating the signal into frames, b) means associated with the means for separating for evaluating levels of each sample within a frame, c) means associated with the means for evaluating for calculating a first percentage of samples whose values are within a predefined second percentage of the value of the sample with the highest level, and d) means associated with the means for calculating for identifying the frame as noise if the first percentage is below a predefined amount.

17. In a signal processing system, apparatus for identifying a transition from background noise to speech in a signal containing speech and noise, comprising a) means for separating the signal into frames, b) means associated with the means for separating for evaluating energy levels of three adjacent frames immediately following frames of noise, c) means associated with the means for evaluating for comparing the level of the third of the adjacent frames with each of the first and second of the adjacent frames' levels, and d) means associated with the means for comparing for identifying the third frame as indicative of a transition from noise to speech if either comparison yields a difference which exceeds a predetermined amount.

18. The apparatus of claim 17 wherein the means for identifying identifies the third frame as indicative of a transition from noise to speech if either comparison yields a difference which exceeds a first predetermined energy level if the energy level of the third frame is above a predetermined energy threshold or exceeds a second predetermined energy level if the energy level of the third frame is below the energy threshold.

19. In a signal processing system, apparatus for identifying background noise in a signal containing speech and noise, comprising a) means for separating the signal into frames, b) means for evaluating energy levels of the frames in a segment comprising at least three adjacent frames, c) means for calculating a difference value between the level of the last of the adjacent frames and the average energy level of the frames in the segment, and d) means for identifying the last frame as noise if the difference value is less than a predetermined amount.

20. The apparatus of claim 19 wherein a margin is added to the predetermined amount.

21. In a signal processing system wherein a first frame has been characterized as either speech or noise, apparatus for characterizing the next frame following the first frame as either speech or noise, comprising a) an evaluator for evaluating energy levels of the frames, b) the comparison device associated with the evaluator for comparing the difference in levels of the frames to a predetermined value, and c) an identification device associated with the comparison device for identifying the next frame as the same characterization as the first frame if the difference is below the value.

22. The apparatus of claim 21 wherein the value is a first value if the signal is above an energy threshold and a second value if the signal is below the energy threshold.

23. In a signal processing system, apparatus for identifying background noise in a signal containing speech and noise, comprising a) a separator that separates the signal into frames, b) an evaluation device associated with the separator for evaluating energy levels of three adjacent frames, and c) an identifying device associated with the evaluation device for identifying the frames as non-speech if the levels do not exhibit monotonic behavior in energy level.

24. In a signal processing system, apparatus for identifying background noise in a signal containing speech and noise, comprising a) a separator that separates the signal into frames, b) an evaluator associated with the separator for evaluating levels of each sample within a frame, c) a calculator associated with the evaluator for calculating a first percentage of samples whose values are within a predefined second percentage of the value of the sample with the highest level, and d) an identification device associated with the calculator for identifying the frame as noise if the first percentage is below a predefined amount.

25. In a signal processing system, apparatus for identifying a transition from background noise to speech in a signal containing speech and noise, comprising a) a separator for separating the signal into frames, b) an evaluator associated with the separator for evaluating energy levels of three adjacent frames, c) a comparator associated with the evaluator for comparing the level of the third of the adjacent frames with each of the first and second of the adjacent frames' levels, and d) an identifier associated with the comparator for identifying the third frame as indicative of a transition from noise to speech if either comparison yields a difference value which exceeds a first predetermined energy level if the energy level of the third frame is above a predetermined energy threshold or exceeds a second predetermined energy level if the energy level of the third frame is below the energy threshold, when the frames immediately prior to the three adjacent frames were noise frames.

26. In a signal processing system, apparatus for identifying background noise in a signal containing speech and noise, comprising a) a separator for separating the signal into frames, b) an evaluator associated with the separator for evaluating energy levels of the frames of a segment comprising at least three adjacent frames, c) a calculator associated with the evaluator for calculating a difference value between the last of the adjacent frames and the average energy level of the frames of the segment, and d) an identification device associated with the calculator for identifying the last frame as noise if the difference value is less than a predetermined amount.

27. The apparatus of claim 26 wherein a margin is added to the predetermined amount.

* * * * *